US007646269B2

(12) United States Patent
Weister et al.

(10) Patent No.: US 7,646,269 B2
(45) Date of Patent: Jan. 12, 2010

(54) ELECTRICAL SWITCHING APPARATUS, AND CONDUCTOR ASSEMBLY AND SHUNT ASSEMBLY THEREFOR

(75) Inventors: Nathan J. Weister, Darlington, PA (US); Paul R. Rakus, Beaver Falls, PA (US); John J. Shea, Pittsburgh, PA (US); William C. Pollitt, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/682,968

(22) Filed: Mar. 7, 2007

(65) Prior Publication Data

US 2008/0218296 A1 Sep. 11, 2008

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 53/00*** | (2006.01) |
| ***H01H 3/00*** | (2006.01) |
| ***H01H 9/38*** | (2006.01) |
| ***H01H 33/12*** | (2006.01) |
| ***H01H 33/66*** | (2006.01) |

(52) U.S. Cl. ..... 335/16; 335/147; 335/195; 218/22

(58) Field of Classification Search ..... 335/12, 335/16, 147, 95; 218/22

See application file for complete search history.

(56) References Cited

U.S. PATENT DOCUMENTS

| | | | | | |
|---|---|---|---|---|---|
| 2,083,304 | A | * | 6/1937 | Lindstrom | 335/24 |
| 2,186,251 | A | * | 1/1940 | Lindstrom | 335/127 |
| 3,523,261 | A | * | 8/1970 | Achille et al. | 335/16 |
| 3,663,906 | A | * | 5/1972 | Barkan et al. | 335/195 |
| 3,665,350 | A | * | 5/1972 | Klint | 335/195 |
| 4,281,303 | A | * | 7/1981 | Heft | 335/16 |
| 4,346,357 | A | * | 8/1982 | Kussy et al. | 335/16 |
| 4,635,012 | A | * | 1/1987 | Kohanawa et al. | 335/16 |
| 4,887,057 | A | * | 12/1989 | Gula et al. | 335/190 |
| 4,891,617 | A | * | 1/1990 | Beatty et al. | 335/46 |
| 4,891,618 | A | * | 1/1990 | Paton | 335/195 |
| 4,951,019 | A | * | 8/1990 | Gula | 335/166 |
| 4,996,507 | A | * | 2/1991 | McKee et al. | 335/195 |
| 5,023,583 | A | * | 6/1991 | Bratkowski et al. | 335/195 |
| 5,032,813 | A | * | 7/1991 | Gula et al. | 335/195 |
| 5,057,806 | A | | 10/1991 | McKee et al. | |
| 5,200,724 | A | | 4/1993 | Gula et al. | |
| 5,771,145 | A | * | 6/1998 | Seymour et al. | 361/93.2 |
| 5,793,270 | A | * | 8/1998 | Beck et al. | 335/16 |

(Continued)

*Primary Examiner*—Elvin G Enad
*Assistant Examiner*—Alexander Talpalatskiy
(74) *Attorney, Agent, or Firm*—Martin J. Moran

(57) ABSTRACT

A shunt assembly is provided for an electrical switching apparatus including a conductor assembly having a load conductor and a movable contact assembly with a number of movable contact arms. The movable contact assembly is movable in response to a fault current. The shunt assembly includes a number of flexible conductive elements each having a first end electrically connected to the load conductor, a second end electrically connected to a corresponding one of the movable contact arms, and a number of bends disposed between the first and second ends. At least one constraint element is disposed proximate a corresponding one of the bends and constrains movement of the flexible conductive element in response to the fault current, thereby translating the magnetic repulsion force associated with the fault current into a corresponding torque of the movable contact arms of the movable contact assembly.

1 Claim, 3 Drawing Sheets

U.S. PATENT DOCUMENTS 5,912,605 A * 6/1999 Eberts ..... 335/16
6,005,206 A 12/1999 Rakus et al.
6,015,959 A * 1/2000 Slepian et al. ..... 200/400
6,570,116 B2 * 5/2003 Maulandi et al. ..... 218/22
6,977,568 B1 * 12/2005 Rakus et al. ..... 335/16
7,034,642 B1 * 4/2006 Rakus et al. ..... 335/16

* cited by examiner

ELECTRICAL SWITCHING APPARATUS, AND CONDUCTOR ASSEMBLY AND SHUNT ASSEMBLY THEREFOR

CROSS REFERENCE TO RELATED APPLICATION

This Application is related to commonly assigned, copending application Ser. No. 11/549,277, filed Oct. 13, 2006, entitled "Electrical Switching Apparatus, and Conductor Assembly and Independent Flexible Conductive Elements Therefor," which is hereby incorporated herein by reference.

BACKGROUND OF THE INVENTION

1. Field of the Invention

The invention relates generally to electrical switching apparatus and, more particularly, to conductor assemblies for electrical switching apparatus, such as circuit breakers. The invention also relates to shunt assemblies for circuit breaker conductor assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

The electrical contact assemblies of low-voltage circuit breakers, for example, generally comprise a conductor assembly including a movable contact assembly having a plurality of movable contacts, and a stationary contact assembly having a plurality of corresponding stationary contacts. The movable contact assembly includes a plurality of movable contact arms or fingers, each carrying one of the movable contacts and being pivotably coupled to a contact arm carrier. The contact arm carrier is itself pivotable about a number of pivot pins, pivoted by a protrusion or arm on the pole shaft of the circuit breaker operating mechanism to move the movable contacts into and out of electrical contact with the corresponding stationary contacts of the stationary contact assembly. The contact arm carrier includes a contact spring assembly structured to bias the fingers of the movable contact assembly against the stationary contacts of the stationary contact assembly in order to provide and maintain contact pressure when the circuit breaker is closed, and to accommodate wear.

"Blow-on" schemes are commonly employed by low-voltage circuit breakers and are discussed, for example, in U.S. Pat. No. 6,005,206, which is hereby incorporated herein by reference.

The movable contact assembly is electrically connected to a generally rigid conductor of the conductor assembly by flexible conductors, commonly referred to as shunts. More specifically, each shunt is coupled at one end to the generally rigid conductor, and at the other end to a corresponding one of the fingers of the movable contact assembly. The shunts include a number of bends to accommodate the motion of the contact arm carrier and fingers with respect to the generally rigid conductor during a trip condition. Specifically, under over-current or fault conditions, energy flowing through the shunts results in a magnetic repulsion force which tends to straighten the bends of the shunts. However, the magnetic repulsion force is, in general, not translated into torque of the fingers of the movable contact assembly as efficiently and effectively as possible, resulting in blow-on performance of the circuit breaker that is less than desired. In other words, it is desirable to transfer the magnetic repulsion force associated with the shunts into positive torque (e.g., rotation) of the fingers in order to load the electrical contacts and thereby withstand relatively high fault currents.

There is, therefore, room for improvement in shunt assemblies for low-voltage circuit breaker conductor assemblies.

SUMMARY OF THE INVENTION

These needs and others are met by embodiments of the invention, which are directed to a conductor assembly for an electrical switching apparatus such as, for example, a low-voltage circuit breaker, and a shunt assembly therefor, which optimizes the forces on the movable arms of the conductor assembly and thereby improves the withstand performance of the circuit breaker.

As one aspect of the invention, a shunt assembly is provided for an electrical switching apparatus. The electrical switching apparatus includes a conductor assembly having a load conductor and a movable contact assembly with a number of movable contact arms. The movable contact assembly is movable in response to a fault current. The shunt assembly comprises: at least one flexible conductive element including a first end structured to be electrically connected to the load conductor, a second end disposed distal from the first end and being structured to be electrically connected to a corresponding one of the movable contact arms, and a number of bends being disposed between the first end and the second end; and at least one constraint element structured to be disposed proximate a corresponding one of the bends. In response to the fault current, the at least one flexible conductive element is subject to a magnetic repulsion force having a tendency to straighten the number of bends of such flexible conductive element. The at least one constraint element is structured to constrain movement of such flexible conductive element, in order to translate the magnetic repulsion force into a corresponding torque of the movable contact arms of the movable contact assembly.

The at least one constraint element may comprise a restraint member, wherein the restraint member is structured to be coupled to a portion of the movable contact assembly in order that the restraint member does not move independently with respect to the movable contact assembly. When the at least one flexible conductive element is subject to the magnetic repulsion force, the restraint member may abut such flexible conductive element at or about the corresponding one of the bends. The restraint member may include a first side and a second side, wherein the second side of the restraint member includes a curved surface corresponding to a portion of the corresponding one of the bends.

The at least one flexible conductive element may be structured to move among a first position and a second position corresponding to the electrical switching apparatus being subject to the fault current. The number of bends may be a first bend and a second bend. The restraint member may be a first restraint member disposed at or about the first bend, wherein the at least one constraint element further comprises a second restraint member, and wherein, when the at least one flexible conductive element is disposed in the first position, the second restraint member is disposed at or about the second bend in order to constrain movement of the second bend. The at least one flexible conductive element may be a plurality of shunts and, when the shunts are subject to the magnetic repulsion force, the first restraint member may be structured to impose a first restraining force on each of the shunts normal to the first bend thereof, and the second restraint member may be structured to impose a second restraining force on the shunts normal to the second bend thereof.

As another aspect of the invention, a conductor assembly for an electrical switching apparatus comprises: a load conductor; a movable contact assembly comprising a number of movable contact arms, the movable contact assembly being structured to move in response to a fault current of the electrical switching apparatus; and a shunt assembly comprising: at least one flexible conductive element including a first end electrically connected to the load conductor, a second end disposed distal from the first end and being electrically connected to a corresponding one of the movable contact arms, and a number of bends being disposed between the first end and the second end, and at least one constraint element disposed proximate a corresponding one of the bends. In response to the fault current, the at least one flexible conductive element is subject to a magnetic repulsion force having a tendency to straighten the number of bends of such flexible conductive element. The at least one constraint element constrains movement of such flexible conductive element, in order to translate the magnetic repulsion force into a corresponding torque of the movable contact arms of the movable contact assembly.

As another aspect of the invention, an electrical switching apparatus comprises: an enclosure; a stationary contact assembly housed by the enclosure and including a number of stationary electrical contacts; and a conductor assembly housed by the housing, the conductor assembly comprising: a load conductor, a movable contact assembly comprising a number of movable contact arms each having a movable contact, the movable contact being movable into and out of electrical contact with a corresponding one of the stationary electrical contacts of the stationary contact assembly in response to a fault current of the electrical switching apparatus, and a shunt assembly comprising: at least one flexible conductive element including a first end electrically connected to the load conductor, a second end disposed distal from the first end and being electrically connected to a corresponding one of the movable contact arms, and a number of bends being disposed between the first end and the second end, and at least one constraint element disposed proximate a corresponding one of the bends. In response to the fault current, the at least one flexible conductive element is subject to a magnetic repulsion force having a tendency to straighten the number of bends of such flexible conductive element. The at least one constraint element constrains movement of such flexible conductive element, in order to translate the magnetic repulsion force into a corresponding torque of the movable contact arms of the movable contact assembly.

The movable contact assembly may further comprise a first side plate, a second side plate, and at least one pivot member extending between the first side plate and the second side plate. The restraint member may include a first side, a second side, a first end of the restraint member, and a second end of the restraint member disposed opposite and distal from the first end of the restraint member. The movable contact assembly may further comprise a contact spring assembly disposed between the first side plate and the second side plate, and the contact spring assembly may comprise a housing and plurality of biasing elements housed by the housing. The first side of the restraint member may be disposed adjacent the housing of the contact spring assembly, and may include a protrusion which engages the housing of the contact spring assembly in order to maintain the position of the restraint member with respect to the contact spring assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
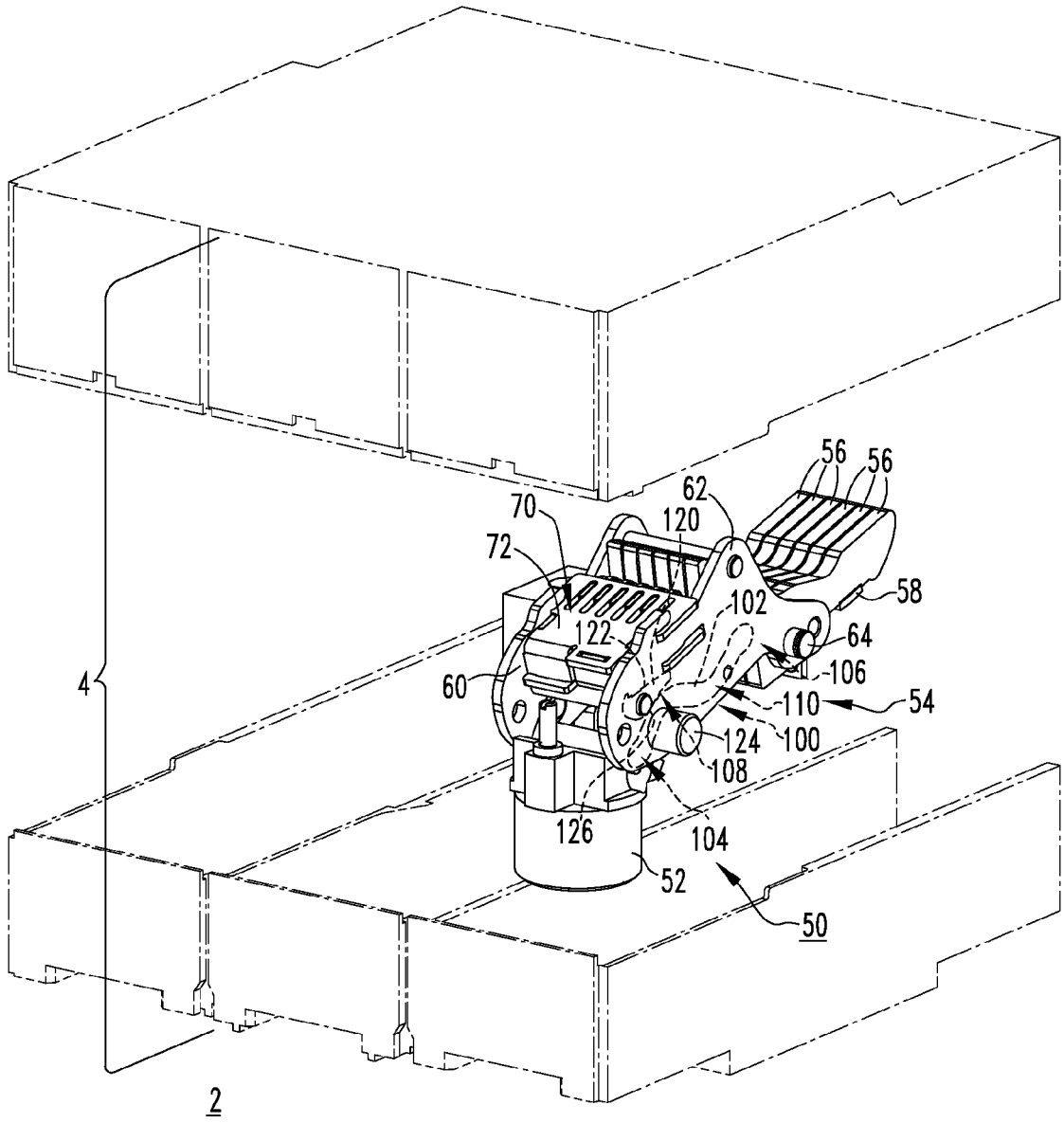
FIG. 1 is an isometric view of a low-voltage circuit breaker, shown in simplified form in phantom line drawing, and one of the conductor assemblies and a shunt assembly therefor, in accordance with an embodiment of the invention.

For purposes of illustration, embodiments of the invention will be described as applied to a device for efficiently translating the magnetic repulsion force in generally S-shaped shunts for low-voltage circuit breaker conductor assemblies into torque of the movable contact arms of the movable contact assembly of the breaker, although it will become apparent that they could also be applied to translate such force in flexible conductive elements which are arranged in any suitable number and/or configuration for use in a wide variety of electrical switching apparatus (e.g., without limitation, circuit switching devices and other circuit interrupters, such as contactors, motor starters, motor controllers and other load controllers) other than low-voltage circuit breakers.

Directional phrases used herein, such as, for example, left, right, top, bottom, upper, lower, front, back, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 4A:
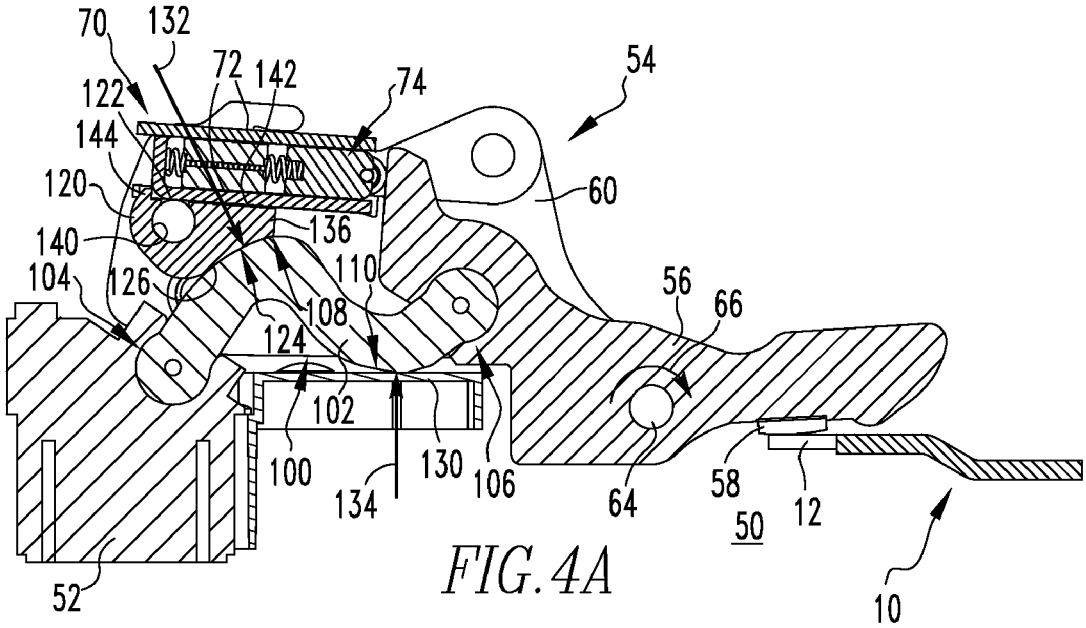
FIGS. 4A and 4B are side elevation cross-sectional views of the conductor assembly and shunt assembly therefor of FIG. 1, in the closed and tripped open positions, respectively.
Figure 4B:
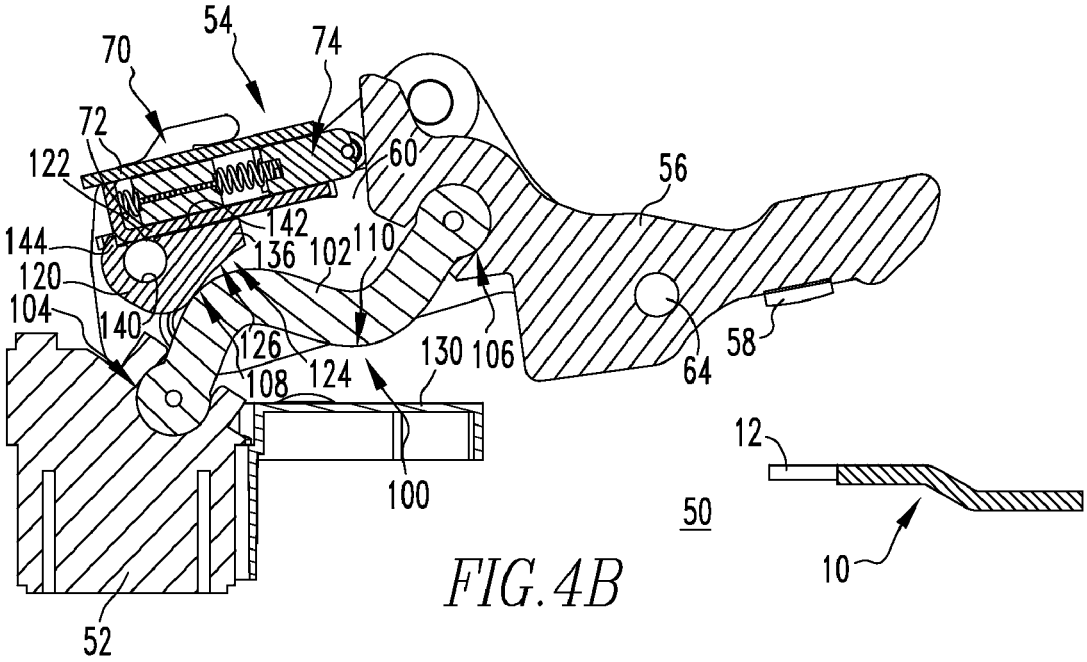

FIG. 1 shows an electrical switching apparatus, such as a low-voltage circuit breaker 2, including a conductor assembly 50 and shunt assembly 100 therefor, in accordance with embodiments of the invention. The low-voltage circuit breaker 2 includes an enclosure 4 (shown in simplified form in phantom line drawing in FIG. 1), a stationary contact assembly 10 (partially shown in FIGS. 4A and 4B) including a number of stationary electrical contacts 12 (one stationary electrical contact 12 is shown in FIGS. 4A and 4B), and the conductor assembly 50, which is housed by the enclosure 4. Although one conductor assembly 50 is shown in FIG. 1, it will be appreciated that the circuit breaker 2 may have any suitable number of poles (circuit breaker 2 of FIG. 1 has three poles) and corresponding conductor assemblies 50 therefor.

As shown in FIGS. 1, 2, 4A and 4B, the conductor assembly 50 includes a load conductor 52, a movable contact assembly 54, and the aforementioned shunt assembly 100. More specifically, the movable contact assembly 54 includes a number of movable contact arms 56 (see, for example, the six movable contact arms 56 of the example movable contact assembly 54 shown in FIG. 1; see also the five movable contact arms 56 shown in FIG. 2) each having a movable contact 58 structured to be movable into (FIG. 4A) and out of (FIG. 4B) electrical contact with a corresponding one of the stationary electrical contacts 12 (FIGS. 4A and 4B) of the stationary contact assembly 10 (FIGS. 4A and 4B) in response to a fault current (e.g., without limitation, an over current condition; and overload condition; an under voltage condition; a relatively high level short circuit or fault condition; a ground fault condition; an arc fault condition) of the circuit breaker 2.

The shunt assembly 100 includes at least one flexible conductive element 102 having a first end 104 and a second end 106 disposed distal from the first end 104. The first end 104 is structured to be electrically connected to the load conductor 52, and the second end 106 is structured to be electrically connected to a corresponding one of the movable contact arms 56 of the movable contact assembly 54. The example shunt assembly 100 includes five (FIG. 2) or six (FIG. 1) flexible conductive elements 102 (one shunt 102 is shown in hidden line drawing in FIG. 1; two shunts 102 are visible in the isometric view of FIG. 2; and one shunt 102 is shown in section in FIGS. 4A and 4B), one for each movable contact arm 56 of the movable contact assembly 54. The example flexible conductive elements 102 are shunts comprised of layered conductive ribbon (un-numbered but partially shown in exaggerated form in FIG. 2), and include first and second bends 108,110 disposed between the first and second ends 104,106, as shown. Such shunts 102 are described in greater detail, for example, in U.S. patent application Ser. No. 11/549,277, which has been incorporated herein. The manner in which the first and second ends 104,106 of the shunts 102 are electrically connected and mechanically coupled to the load conductor 52 and corresponding movable contact arm 56, respectively, and the general operation of the conductor assembly 50, for example, in response to the fault current, is also discussed, for example, in U.S. patent application Ser. No. 11/549,277.

It will be appreciated that the conductor assembly 50 could contain any suitable alternative number and configuration of shunts 102 other than those shown and described herein, without departing from the scope of the invention. It will also be appreciated that, although the example shunts 102 include two bends 108,110, resulting in a shunt 102 which is generally S-shaped (best shown in FIGS. 4A and 4B), each shunt 102 could alternatively have any suitable number of bends (e.g., without limitation, one bend; more than two bends) and corresponding configuration (not shown).

In response to the fault current, the shunts 102 are subject to a magnetic repulsion force having a tendency to straighten the bends 108,110 thereof. This tendency to straighten has caused known shunt designs to be relatively in-effective in transmitting motion of the shunts 102 into the desired corresponding blow-on torque of the movable contact arms 56 of the movable contact assembly 54. This inhibits the circuit breaker 2 (FIG. 1) withstand. Specifically, blow-on performance and associated withstand, is lower than desired. The blow-on and withstand performance of the circuit breaker (FIG. 1) relates to the ability of the movable contact assembly 54 to move (e.g., apply torque to) the movable contact arm 56 and associated movable electrical contact 58 in a manner which maintains electrical contact between the movable electrical contact 58 and the corresponding stationary electrical contact 12, as shown in FIG. 4A, in order to withstand a pre-determined fault current (e.g., without limitation, current rating), without opening the separable contacts 12,58, as shown in FIG. 4B.

The disclosed conductor assembly 50 and shunt assembly 100 therefor, address and overcome the aforementioned disadvantage by providing at least one constraint element 120 structured to constrain movement of the shunts 102, and thereby effectively translate the magnetic repulsion force into a corresponding torque of the movable contact arms 56 of the movable contact assembly 54. In other words, the constraint element 120 functions somewhat like a fulcrum for the shunts 102 to resist in-efficient movement (e.g., straightening of the bends 108,110) thereof, and instead directly transmit the energy associated with the magnetic repulsion force into effective electrical contact force to improve withstand performance. In particular, the magnetic repulsion force is translated into torque of the movable contact arms 56 and movable electrical contacts 58 thereof. As will be discussed herein, to accomplish this objective, the example shunt assembly 100 includes two constraint elements, a first restraint member 120 and a second restraint member 130. The first restraint member 120 is coupled to a portion of the movable contact assembly 54 in order that it does not move independently with respect thereto. The first restraint member 120 is disposed at or about the first bend 108 of each shunt 102 and, when the shunt 102 is disposed in the un-actuated position of FIG. 4A, the second restraint member, which in the example shown and described herein is a shunt block 130 disposed proximate the load conductor 52, is disposed at or about the second bend 110, in order to constrain movement of the second bend 110 of the shunt 102.

Operation of the shunt assembly 100 will now be described with reference to FIGS. 4A and 4B. For economy of disclosure, only one shunt 102 of the shunt assembly 100 will be described with respect to the restraint members 120,130. It will, however, be appreciated that the other shunts 102 are also controlled (e.g., without limitation, directed; constrained) by the first and second restraint members 120,130 in substantially the same manner. Specifically, the shunts 102 are movable among a first (e.g., closed) position (FIG. 4A) and a second (e.g., open) position (FIG. 4B) corresponding to the circuit breaker operating mechanism (not shown) having tripped open the separable contacts 12,58 open in response to a trip condition. Specifically, when the shunt 102 is disposed in the first position of FIG. 4A, the first bend 108 of the shunt 102 is constrained by the first restraint member 120, and the second bend 110 of each shunt 102 constrained by the second constraint member 130. When the shunt 102 is subject to the magnetic repulsion force in response to a fault current, the first and second bends 108,110 of the shunt 102 have a tendency to straighten. At this point, the first restraint member 120 abuts the shunt 102 at or about the first bend 108 and resists the first bend 108 from straightening, and the second restraint member 130 resists the second bend 110 from straightening. The difference in position between this blow-on condition and the closed position of FIG. 4A is relatively insignificant and, therefore, for economy of disclosure, has not been expressly shown. In this manner, the magnetic repulsion force is transferred directly to the second end 106 of the shunt 102, in order to provide torque of the corresponding one of the movable contact arms 56 of the movable contact assembly 54 (clockwise about pin member 64 in the direction indicated by arrow 66 of FIG. 4A) until the circuit breaker operating mechanism (not shown) opens the separable contacts 12,58 (FIG. 4B). More specifically, when the shunt 102 is subject to the magnetic repulsion force, the first restraint member 120 imposes a first restraining force 132 on the shunt 102 normal to the first bend 108 thereof, and the second restraint member 130 imposes a second restraining force 134 on the shunt 102 normal to the second bend 110 thereof, as indicated generally by arrows 132 and 134 of FIG. 4A. In this manner, energy of the magnetic repulsion force is effectively and efficiently directed down the shunt 102 to the second end 106 thereof and into torque of the movable contact arms 56 of the movable contact assembly 54.

Figure 2:
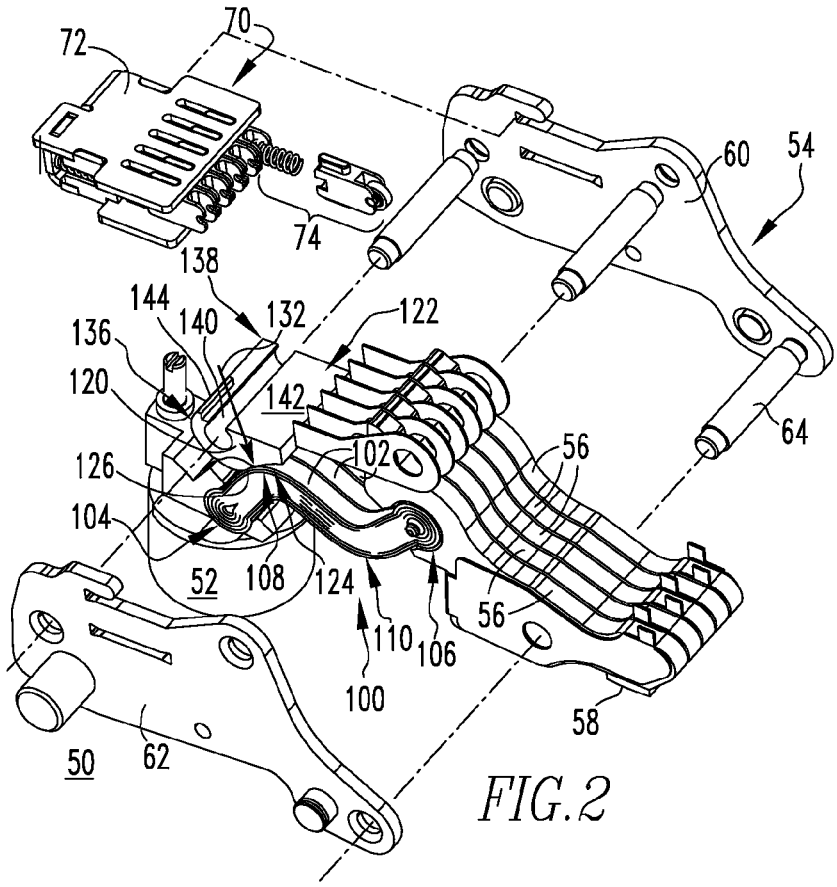
FIG. 2 is an exploded isometric view of the conductor assembly and shunt assembly therefor of FIG. 1.

As shown in FIGS. 2, 3A, 3B, 3C, 4A and 4B, the example first restraint 120 includes a first side 122 and a second side 124. The second side 124 has a curved surface 126 corresponding to a portion of the first bend 108 of the shunt 102 (FIGS. 2, 4A and 4B).

As shown in FIGS. 1, 2, 4A and 4B, the example movable contact assembly 54 includes a first side plate 60, a second side plate 62, and at least one pivot member 64 extending therebetween. The first restraint member 120, in addition to the aforementioned first and second sides 122,124, also includes a first end 136 and a second end 138 disposed opposite and distal from the first end 136 (best shown in FIGS. 2, 3A, 3B and 3C). The example first restrain member 120 includes an elongated aperture 140 which extends between the first and second ends 136,138 of the restraint member 120 and receives a fastener (e.g., pin member) of the movable contact assembly 54 (FIGS. 2, 4A and 4B). The example first restraint member 120 is a single-piece member extending between the first and second side plates 60,62 of the movable contact assembly 54, although it will be appreciated that any suitable alternative number and configuration of constraint elements (e.g., without limitation, a cylindrical dowel (not shown)) could be employed without departing from the scope of the invention.

Figure 3A:
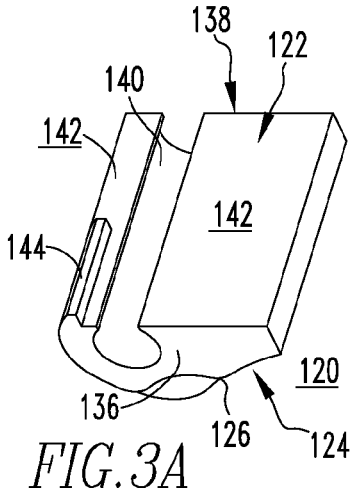
FIG. 3A is an isometric view of the top side of the constraint element of the shunt assembly of FIG. 1.
Figure 3B:
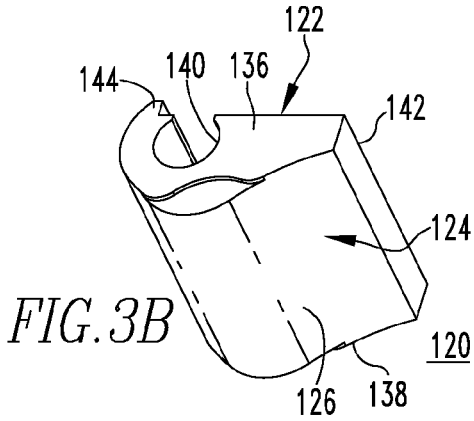
FIG. 3B is an isometric view of the bottom side of the constraint element of FIG. 3A.
Figure 3C:
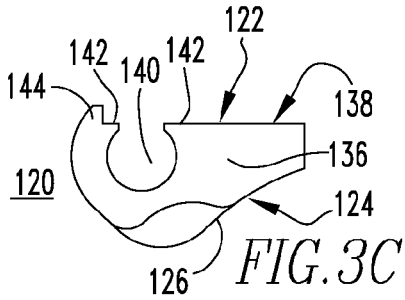
FIG. 3C is an end elevation view of the constraint element of FIG. 3A.

The example movable contact assembly 54 further includes a contact spring assembly 70, which is also disposed between the first and second side plates 60,62. More specifically, the contact spring assembly 70 includes a housing 72 and a plurality of biasing elements 74 (one biasing element 74 is shown in the exploded view of FIG. 2) housed by the housing 72. Each of the biasing elements 74 is structured to bias a corresponding one of the movable contact arms 56 and the movable contact 58 coupled thereto, toward electrical connection with a corresponding one of the stationary electrical contacts 12 (one stationary electrical contact is shown in FIGS. 4A and 4B). Specifically, the movable contact arms 56 are biased clockwise about pivot member 64 in the direction indicated by arrow 66 in FIG. 4A. Contact spring assemblies aredescribed, for example, in U.S. patent application Ser. No. 11/549,277, w hich has been incorporated herein. As best shown in FIGS. 3A-3C, the first side 122 of the example single-piece first restraint member 120 includes a generally planar portion 142 and a protrusion 144 extending outwardly from the planar portion 142. The first side 122 of the example first restraint member 120 is disposed adjacent the housing 72 of the contact spring assembly 70, and the protrusion 144 engages a portion of the housing 72, as shown in FIGS. 4A and 4B, in order to maintain the position of the first restraint member 120 with respect thereto. In this manner, the first restraint member 120 pivots with the contact spring assembly 70, but not independently with respect thereto, as previously discussed.

Accordingly, the disclosed low-voltage circuit breaker 2 (FIG. 1), and conductor assembly 50 (FIGS. 1, 2, 4A and 4B) and shunt assembly 100 (FIGS. 1, 2, 4A and 4B) therefor, provide a mechanism (e.g., without limitation, at least one constraint element 120,130) for effectively and efficiently transmitting motion of the flexible conductive members (e.g., shunts 102) of the conductor assembly 50 into torque of the movable contact arms 56 of the movable contact assembly 54, to improve the withstand of the circuit breaker 2 (FIG. 1).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

an enclosure;

a stationary contact assembly housed by said enclosure and including a number of stationary electrical contacts; and a conductor assembly housed by said enclosure, said conductor assembly comprising:

a load conductor, a movable contact assembly comprising a number of movable contact arms each having a movable contact, said movable contact being movable into and out of electrical contact with a corresponding one of said stationary electrical contacts of said stationary contact assembly in response to fault current of said electrical switching apparatus, and a shunt assembly comprising:

at least one flexible conductive element including a first end electrically connected to said load conductor, a second end disposed distal from said first end and being electrically connected to a corresponding one of said movable contact arms, and a number of bends being disposed between the first end and the second end, and at least one constraint element disposed proximate a corresponding one of said bends, wherein in response to said fault current, said at least one flexible conductive element is subject to a magnetic repulsion force having a tendency to straighten said number of bends of said at least one flexible conductive element, wherein said at least one constraint element constrains movement of said at least one flexible conductive element, in order to translate said magnetic repulsion force into a corresponding torque of said number of movable contact arms of said movable contact assembly, wherein said at least one constraint element comprises a restraint member; wherein said restraint member is coupled to a portion of said movable contact assembly in order that said restraint member does not move independently with respect to said movable contact assembly; and wherein, when said at least one of said flexible conductive element is subject to said magnetic repulsion force, said restraint member abuts said at least one flexible conductive element at or about said corresponding one of said bends, wherein said movable contact assembly further comprises a first side plate, a second side plate, and at least one pivot member extending between said first side plate and said second side plate; wherein said restraint member includes a first side, a second side, a first end of said restraint element, and a second end of said restraint element disposed opposite and distal from the first end of said restraint element; and wherein said restraint member extends between said first side plate and said second side plate, wherein said movable contact assembly further comprises a contact spring, assembly disposed between said first side plate and said second side plate; wherein said contact spring assembly comprises a housing and plurality of biasing elements housed by said housing; wherein each of said biasing elements is structured to bias a corresponding one of said movable contact arms and said movable contact of said corresponding one of said movable contact arms toward electrical connection with a corresponding one of said number of stationary electrical contacts; wherein the first side of said restraint member is disposed adjacent said housing of said contact spring assembly; and wherein the second side of said restraint member includes a curved surface corresponding to a portion of said corresponding one of said bends, and wherein said restraint member is a single-piece member; wherein the first side of said restraint member comprises a planar portion and a protrusion extending outwardly from said planar portion; and wherein said protrusion engages a portion of said housing of said contact spring assembly in order to maintain the position of said restraint member with respect to said contact spring assembly.

* * * * *